United States Patent [19]

Pujol et al.

[11] 4,185,580

[45] Jan. 29, 1980

[54] SUBMARINE SYSTEM

[75] Inventors: Jean-Claude Pujol, Rennes; Jean-Pierre Gérard, Paris; Paul Madec, Guilers; Daniel Métaut, Brest, all of France

[73] Assignee: Etat Francais, Delegation Ministerielle pour l'Armement, Paris, France

[21] Appl. No.: 290,734

[22] Filed: Sep. 20, 1972

[30] Foreign Application Priority Data

Sep. 21, 1971 [FR] France ..... 71.33835

[51] Int. Cl.[2] ..... B63G 8/00

[52] U.S. Cl. ..... 114/321; 114/331; 114/338; 405/158; 405/191

[58] Field of Search ..... 114/16 R, 16 E, 21 R, 114/21 W, 16.8, 331, 338, 321; 61/69 R, 69 A

[56] References Cited

U.S. PATENT DOCUMENTS

| | | | |
|---|---|---|---|
| 2,981,073 | 4/1961 | Robinson | 114/330 |
| 3,354,658 | 11/1967 | Leonardi | 114/334 X |
| 3,434,443 | 3/1969 | Estabrook | 114/330 X |
| 3,600,898 | 8/1971 | Godfrey | 405/158 |

*Primary Examiner*—David H. Brown

*Attorney, Agent, or Firm*—Stevens, Davis, Miller & Mosher

[57] ABSTRACT

A submarine system comprising a submarine device for operation within a fluid environment. The device is provided with a self-contained source of energy, propulsion components coupled to the energy source, maneuvering components and an environment observation device. A control station located remote from the submarine device is connected to it by means of a transmission cable, the cable being the sole means of transmitting command signals to the device and receiving observation results therefrom.

16 Claims, 5 Drawing Figures

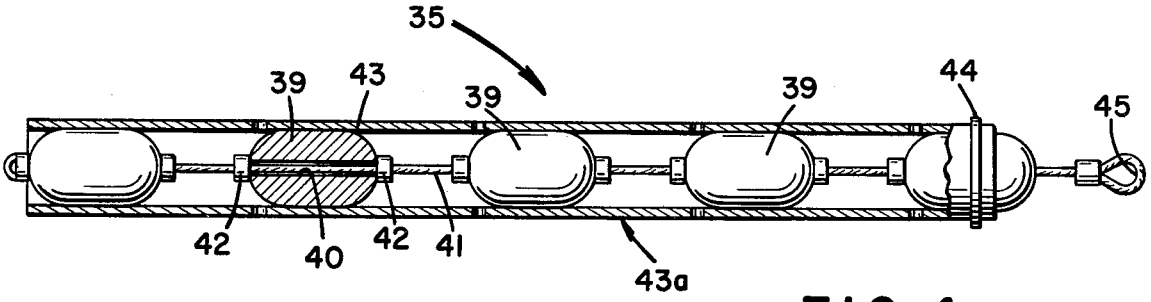
FIG. 4
FIG. 5
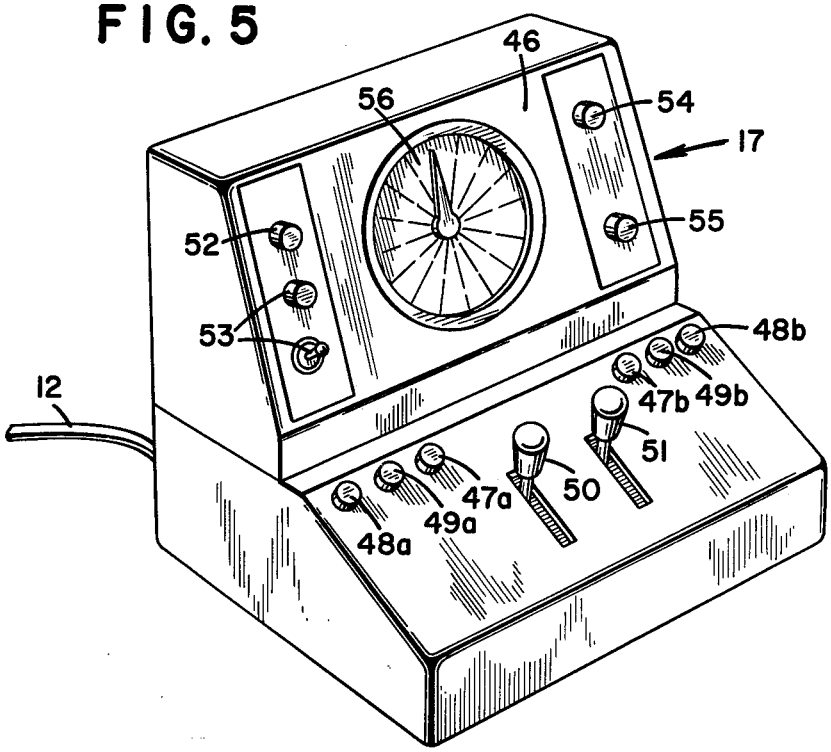

SUBMARINE SYSTEM

BACKGROUND OF THE INVENTION

In the technical field of observation, survey and exploitation of water expanses (mainly seas and oceans) distributed over the Earth's surface, the best devices used up to now are of the submarine type. The most advanced among the latter are provided with self-contained propulsion units, such as the bathyscaph.

The devices of the above-mentioned type however present some disadvantages involving either the need for embarking an operating and/or observation crew or of working in blind conditions. In the case of a manned device, said crew incurs great risks due, in particular, to the high compressive forces exerted by the hydrostatic pressure prevailing in the medium in which the device is being operated, and also to the explosion hazards when it is operated in the vicinity of explosive charges (mines or others). In the absence of a crew, the device maneuvers are not highly dependable and the work done is often of poor quality.

Remote-controlled devices have also been used, but this category comprises devices featuring propulsion systems, observation equipment and working tools actuated by means of motors supplied from a power cable. The size of the cable does not allow such devices to reach a satisfactory range of action in relation to the fixed observation base. Moreover, the observation afforded by this type of device is generally confined to visual guidance performed from a fixed base.

In brief, the previously known devices all present major drawbacks leading to restriction in their use. The users' latent requirement, in fact, relates to a device which, as regards its operating specifications, would have the self-sufficiency and maneuvering accuracy and action similar to the manned bathyscaphs, although avoiding the presence of a crew while still being of the remote-controlled type. Numerous studies and tests based on these general parameters were undertaken and led to the design of a new submarine device which is the subject of the invention.

SUMMARY OF THE INVENTION

The present invention therefore concerns a submarine device provided with a self-contained source of energy, propulsion units connected with said source of energy and maneuvering components, as well as with an environment observation device and, if applicable, with working tools.

A single cable exclusively used for data transmission, such as command signals and/or observation results, interconnects the assembly with a control station. The device advantageously includes a transmission cable stowing compartment, preferably located above and in the vertical center plane of the assembly. Also, the propulsion units often serve as maneuvering elements for the guidance of said device. These propulsion units appropriately consist of at least two reversing motors approximately located within a same plane, called the horizontal plane, and in an approximately symmetrical arrangement with respect to the longitudinal center plane of the device perpendicular to the horizontal plane. When the device is fitted with a fairing, a reversing motor can be installed on each side of the fairing.

The maneuvering elements include means for trimming the device height above the bottom delimiting the marine environment. These trimming means advantageously consist of a guide-rope approximately attached to a point on a horizontal plane including the center of gravity of the device and partly rest on the bottom delimiting the marine environment.

The guide rope-to-device attachment is preferably arranged so as to be detachable, using well-known devices. It consists of a string of bodies with highly concentrated masses, two successive bodies being flexibly interlinked through a low-mass link.

For a given mode of application, each intermediate body is provided with a through-hole accommodating a flexible rope while a spacing device, intended to keep two successive bodies apart, is fitted on said rope between the two said bodies.

This spacing device may include two sleeves attached to the rope approximately at the respective outlets of the hole provided in each of the two corresponding bodies.

Besides, the string of bodies is enclosed in a sheath the outer skin of which is provided with a very good surface finish so as to ensure adequate penetration of the guide-rope into the marine environment.

The device is fitted with an observation system including a camera which can be associated with a radiation projector.

The camera advantageously consists of a television camera connected with the control station through the transmission cable.

This camera is preferably adapted for monitoring the course of said device.

In addition, the device can be equipped with a compartment containing a working tool more especially consisting of a charge. In that case, the center of gravity of the compartment and of the working tool contained in it is located approximately perpendicular to the center of gravity of the assembly or, possibly slightly forward thereof. Moreover, it may prove interesting that the charge, initially inert, be provided with a well-known activation device connected to the transmission cable.

Finally, the device features positive floating characteristics once the guide-rope and/or the releasable compartment are detached from said device immersed in a marine environment.

BRIEF DESCRIPTION OF THE DRAWING

FIG. 4 is a partial cut-away view showing the special structure of the guide-rope which is adapted to be attached to the device illustrated in FIGS. 1 to 3;

FIG. 5 is a perspective view of the control station to which the device is connected.

PREFERRED EMBODIMENT OF THE INVENTION

Figure 1:
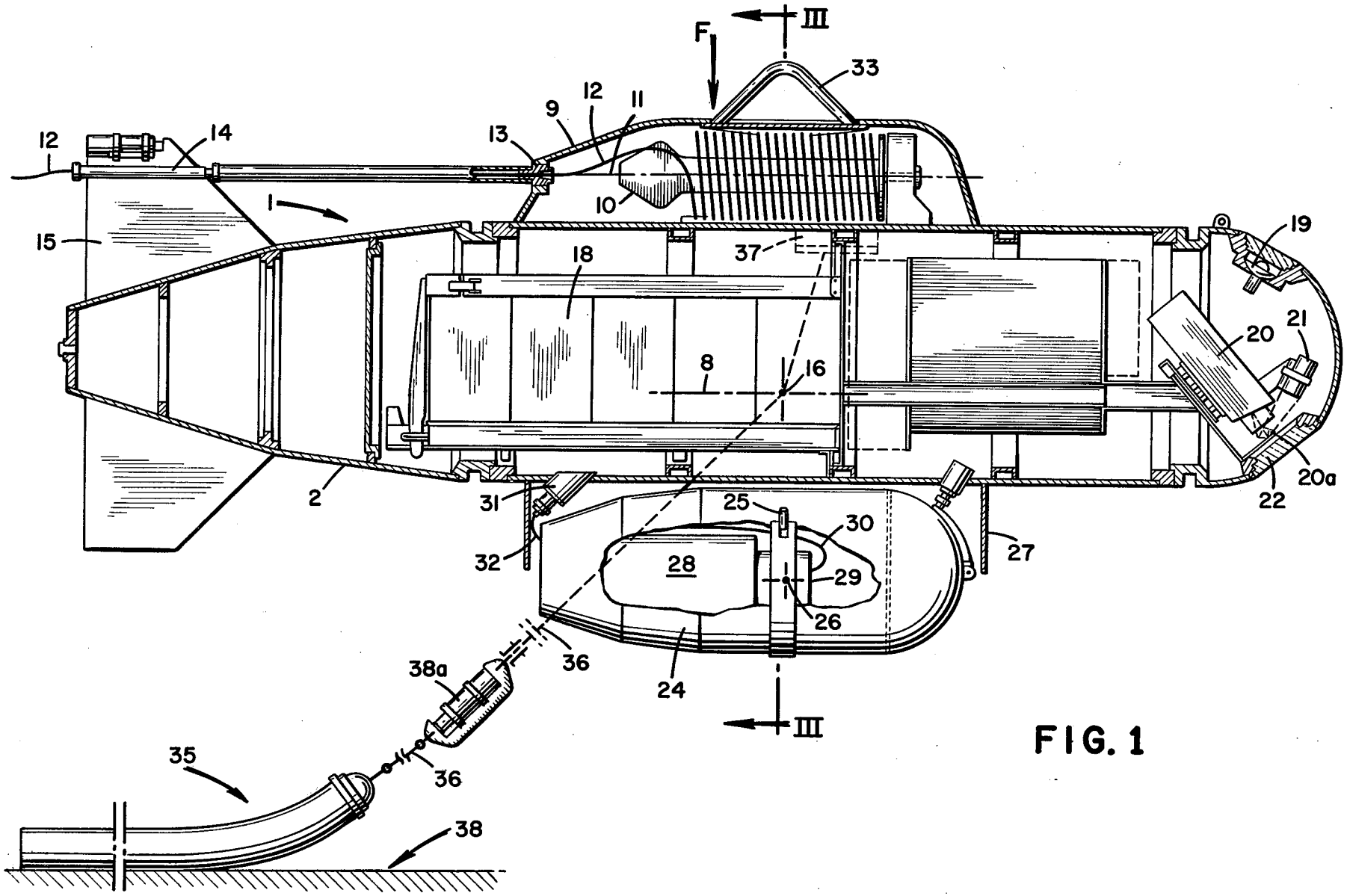
FIG. 1 is a side elevation view, with partial cut-away, of a device in accordance with the invention.
Figure 2:
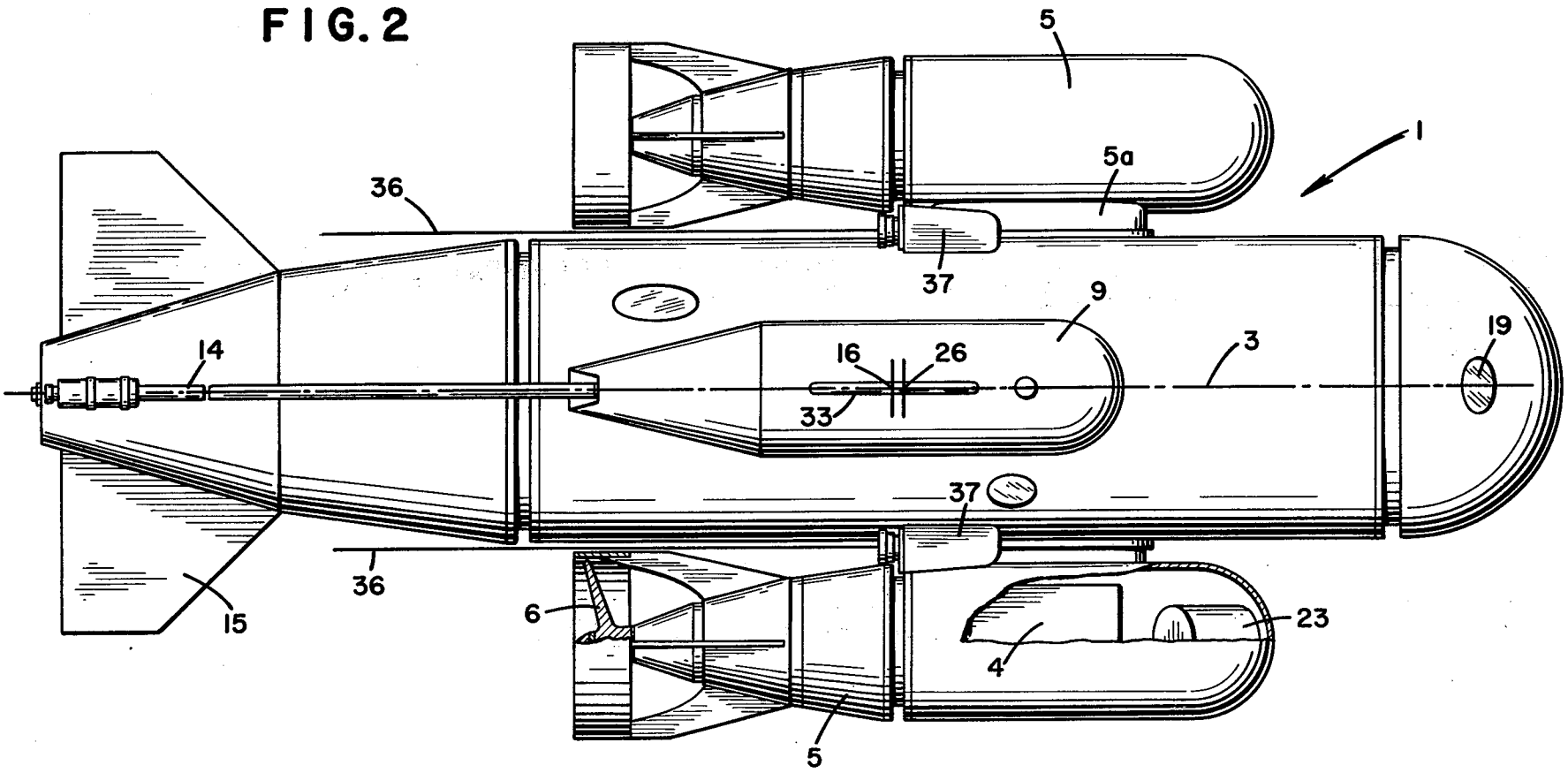
FIG. 2 is a view in the direction of arrow F as shown in FIG. 1.
Figure 3:
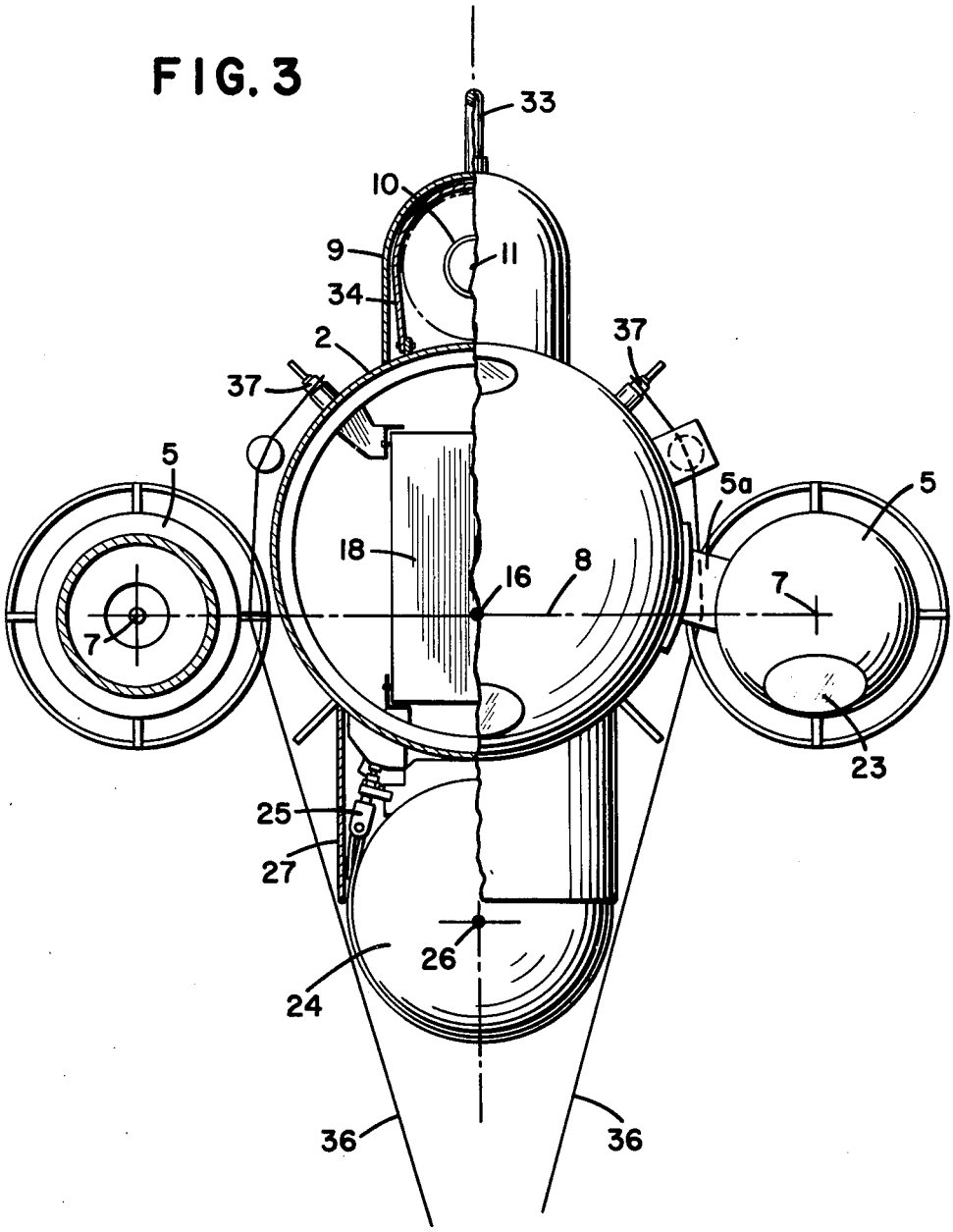
FIG. 3 is a fragmentary cross-sectional view along the line III—III as shown in FIG. 1.

The device described as an example is intended to be a submarine robot suitable for the destruction of mines. It is comprised of a main body 1 delimited by a fairing 2. The latter is streamlined and approximately symmetrical with respect to a vertical center plane 3. There are two propulsion units, each consisting of a motor 4 installed in a fairing 5 and of a propeller 6. These propulsion units are symmetrically arranged with respect to the vertical center plane 3; their shafts 7 are however centered along a horizontal plane 8 which is perpendicular to the vertical center plane 3 containing the center of gravity 16 of body assembly 1. Fairings 5 are attached to fairing 2 by means of attaching fins 5a.

Further, the body assembly 1 is surmounted by compartment 9 accommodating reel 10 fitted on a horizontal shaft 11 parallel to vertical center plane 3. A small-diameter cable 12, exclusively designed for data transmission such as command signals in one direction and observation results in the other, is wound on reel 10. One end of cable 12 is routed outside cable stowing compartment 9 through guide 13, the axis of which is approximately aligned to shaft 11, then through outlet hawse 14, the axis of which is always aligned with the axis of guide 13.

Hawse 14 is attached to upper vertical fin 15 of an empennage secured to the rear of body 1. The end of cable 12 is connected to control station 17 illustrated in FIG. 5, and which is installed ashore or aboard an operational ship.

It is to be noted that the longitudinal axis of compartment 9 is located perpendicular to a transverse plane through the center of gravity 16.

Fairing 2 houses several components including an electrical storage battery 18, a light or radient energy projector 19 allowing the device to be localized at night from the surface and a camera 20 associated with course repeater 21 of the device. Camera 20 is a television camera, the lens 20a of which is placed opposite viewing window 22 provided in fairing 2. In the example shown, camera 20 consists of an optical filming assembly whose operation is combined with that of light or radient energy projectors 23 placed within the front section of propulsion unit fairings 5. Camera 20 and other illumination projector components 19, course repeater 21 and motors 4 are connected to control station 17 through cable 12.

It is also to be noted that compartment 24, made up of a stream-lined tank, is attached to fairing 2 through releasable attaching means 25 such as explosive bolts. The center of gravity 26 of compartment 24, equipped with its internal components, is approximately located below the center of gravity 16 but preferably slightly forward of said center of gravity 16. Besides, compartment 24 is partly covered by a removable cover 27 attached to the lower part of fairing 2. Compartment 24 is generally used for the installation of working tools. In the example shown, compartment 24 contains an explosive charge 28 provided with its firing device 29. In the case where compartment 24 is actually secured to fairing 2, firing control electrical wires 30 are connected to a connector 31 through cable 32. Connector 31 in turn is connected to control station 17 through cable 12.

As regards the structure of body 1, it is to be noted that a handling ring 33 provided at the upper part of compartment 9 is effectively attached to the main part of fairing 2 through attachment lugs 34. In addition, a guide-rope 35 is attached to fairing 2 through cable 36, itself attached to said fairing 2 by means of attaching part 37 fitted with a shear section allowing cable 36 of guide-rope 35 to be cut off when required, for instance, from control station 17. Cable 36 is also equipped with an acoustic marker 38a. Attachment part 37 is approximately located within horizontal plane 8, between one fairing 5 and fairing 2 of main body 1. The guide-rope is trailed by fairing 2 and partly rests on bottom 38 delimiting the device marine environment.

The special structure of guide-rope 35 is illustrated in detail in FIG. 4. As shown, heavy bodies 39 with concentrated masses are each provided with a through-hole 40. Bodies 39 are strung on a flexible stainless steel cable 41 through holes 40. Two sleeves 42, located on either side of a given body 39 and attached to cable 41 (through crimping for instance), are used to maintain said body 39 in position on said cable 41. It can be further seen that the assembly of bodies 39 is enclosed in a sheath 43 whose outer skin 43a has a very clean surface finish, free from roughness. This sheath 43 is attached to one of the extreme bodies 39 by means of a clamp 44. Besides, the end of cable 41, adjacent to the body 39 fitted with clamp 44, is terminated by a loop 45 allowing cable 41 to be coupled with cable 36.

The remaining item to be briefly discussed is control station 17. The latter includes the controls proper together with observation components grouped on a console 46.

The controls mainly consist of knobs 47a, 48a, and 49a and 47b, 48b and 49b used for closing the circuits controlling the rotation of propellers 6 (respectively the port and starboard propellers) during either forward or reverse drive or the stopping of said propellers. Control knobs 50 and 51 are provided for adjusting the rotation speed of the port and starboard propellers. in addition, knob 52 serves to control the opening of attachment means 25 (generally the explosion of the corresponding attaching bolts) and knobs 53 which close the circuit of firing device 29 for charge 28. A knob 54 closes the circuit of the shear section on attachment part 37. Knob 55 is associated with a course resetting mechanism of the device.

Finally, the observation components consist, among others, of dial 56 repeating the device course. Besides, the images taken by camera 20 are transmitted by control station 17 to an associated external monitoring screen.

As previously stated, cable 12 is the support conveying the command signals originating from control station 17 or the observation results sent by the device proper, but does not transmit any motive power, energy being stored aboard the device in the form of a storage battery 18 as in the example shown.

Further, the release of attaching means 25, (causing compartment 24 and charge 28 contained in that compartment to be released) or the shearing of cable 36 by means of the shear section on attachment part 37 (causing guide-rope 35 to be released), or both actions simultaneously will entail either compartment 24 alone or guide-rope 35 alone, or both compartment 24 and guide-rope 35 to be separated from body 1. In each of the above-mentioned cases, the floating characteristics of body 1, equipped with all the components remaining attached to it (fairings 5, compartment 9, etc. . . . ) are positive, said body 1 being supposed to be immersed into the fluid medium in which it is intended to be operated.

The above-mentioned device offers many advantages which will appear more distinctly after reading the following description of the various operating modes of said device.

In its initial configuration, the device is immersed and equipped with its various items of equipment. In particular, guide-rope 35 is secured to attachment part 37 through cable 36. Besides, compartment 24 is secured underneath body 1 whereas a great portion of cable 12, interconnected with control station 17, is stowed inside compartment 9.

If a suspicious object, say a mine, is detected by the detection systems of a ship for instance, the device is set into service in order to identify the suspicious object, on the one hand, and to proceed to its destruction, on the other hand.

Guide-rope 35 partly rests on bottom 38. Its function is to maintain the device at a height approximately constant with respect to bottom 38. Its own structure allows the guide-rope to be weighty enough to maintain the device at the height assigned and to afford the flexibility required to satisfactorily match with the unevenness of bottom 38. As a matter of fact, the effective weight of the guide-rope in the fluid medium is determined by the presence of bodies 39 while the required flexibility is obtained through cable 41. Moreover, it should be noted that the presence of sheath 43 and the excellence of the surface finish of face 43*a* of said sheath allow guide-rope 35 to be trailed smoothly and silently along bottom 38 as well as in the medium in which the device is being displaced.

The displacement of said device results from command signals transmitted by control station 17, upon actuation of knobs 47*a*, 48*a*, 49*a* and 50 and 47*b*, 48*b*, 49*b* and 51, and transmitted to the control circuits of motors 4 via cable 12. As concerns the device control, it should be noted that the arrangement of fairings 5 and propellers 6 allows the device to be driven in the forward and reverse directions, whereas the device course can be changed by causing each motor to rotate in the opposite direction. This feature, associated with the adoption of guide-rope 35 (avoiding the use of hydroplanes) leads to a simple design and outstanding sturdiness of the device concerned. Finally, the symmetrical arrangement of fairings 5 with respect to the center of gravity 16 eliminates spurious gyration torques which would otherwise impair the device maneuvers.

As a result, the device is brought into motion while cable 12 unwinds. The device is slightly lifted since the center of gravity 16 is practially displaced in a vertical direction only, because of the location of reel 10 which is approximately perpendicular to the center of gravity 16. Thus, the above-mentioned arrangement provides a constant attitude (position of the device longitudinal axis with respect to a horizontal plane), the device height being continuously maintained by guide-rope 35).

Once the suspicious object has been located by the device, the latter will then confirm or not the initial doubts. If the suspicions are not confirmed, the device is recovered after possible release of the guide-rope. Releasing the guide-rope will cause the device floating characteristics to become positive; therefore, the device will break surface permitting an easier recovery. If the suspicions are confirmed, command signals are transmitted to the device by actuating knobs 53 to initiate charge 28 (usually fitted with a time-delay device) on the one hand, and by actuating knob 52 to release compartment 24 containing charge 28, on the other hand. The latter operation allows body 1 to break surface and to be recovered undamaged, this being profitable considering the high value of the items fitted on or contained in it (camera 20, course repeater 21, various control and monitoring devices, motors 4, propellers 6, etc. . . . ). Once the time-delay has elapsed, explosive charge 28 will destroy the suspicious object concerned. In addition, it should be noted that the device attitude remains practically unchanged after the release of guide-rope 35 and/or compartment 24, as these two components are approximately attached on the same level as the center of gravity 16. The position of the center of gravity 26, located slightly forward of the center of gravity 16, allows the device nose section to be directed towards the surface of the fluid medium after the release of compartment 24, therefore facilitating the upward motion of body 1.

It is obvious that if the above-described device has been equipped with an explosive charge 28 to cope with military requirements, it may of course be fitted with working tools instead of charge 28 with a view to fulfilling other tasks. The working tools can be installed in compartment 24, or in an equivalent compartment, in lieu of said charge 28.

Finally, emphasis should be laid on the advantages of camera 20 allowing adequate observation of suspicious objects to be made without incurring any risks, the observation results being transmitted to a monitoring screen associated with control station 17 which can be located as remotely as necessary from the device maneuvering area. The distance between the device and control station 17 does not raise any practical problem since, although governed by the length of cable 12, said cable exclusively carries data and no power, thus allowing a cable with low weight per unit of length to be used. Consequently, the total weight of cable 12 does not practically impair the device performance; also, the presence of projectors 23 results in successful operation using camera 20. Furthermore, when the camera is associated with a course repeater 21, as in the case of device illustrated in figures appended, it also allows the position of the suspicious object to be accurately determined which is valuable information for efficient utilization of the device.

What is claimed is:

1. A submarine system comprising a submarine device for operation within a fluid environment having a self-contained source of energy, propulsion components coupled to said source of energy, maneuvering components, and an environment observation device; a control station located remote from said submarine device; and a data transmission cable connecting said submarine device with said control station said cable being of small diameter designed exclusively for data transmission purposes and being the sole link between said submarine device and said control system and being used for transmission of command signals and observation results, said device further including a transmission cable stowing compartment.

2. A submarine system as defined by claim 1 wherein said maneuvering components comprise a guide-rope attached to said submarine device approximately at a point in a horizontal plane including the center of gravity of said submarine device, means are provided for releasing said guide-rope from said submarine device, and a releasable storage compartment is secured to said submarine device, said submarine device exhibiting positive floating characteristics when said guide-rope or said releasable storage compartment is detached from said submarine device immersed in a fluid environment.

3. A submarine system as defined by claim 1 wherein said propulsion components comprise at least two reversing motors approximately located in a horizontal plane and symmetrically disposed with respect to a vertical plane through the longitudinal axis of said submarine device.

4. A submarine system as defined by claim 3 wherein said propulsion components further comprise a fairing housing each of reversing motors.

5. A submarine system as defined by claim 1 wherein said environment observation device comprises a camera and a radiation projector.

6. A submarine system as defined by claim 5 wherein said camera is a television camera interconnected with said control station by means of said transmission cable.

7. A submarine system as defined by claim 1 further comprises a storage compartment containing a working load.

8. A submarine system as defined by claim 7 wherein the center of gravity of said storage compartment and the load contained therein is located forward of the center of gravity of said submarine device, said storage compartment being releasable from said submarine device.

9. A submarine system as define in claim 7 wherein said working tool consists of a charge.

10. A submarine system as defined by claim 9 wherein said charge is initially inert and is provided with an activation device connected to said transmission cable.

11. A submarine system as defined by claim 1 wherein said maneuvering components comprise a guide-rope attached to said submarine device approximately at a point in a horizontal plane including the center of gravity of said submarine device and adapted to rest partly on the bottom surface to control the height of the device above the sea bottom.

12. A submarine system as defined by claim 11 wherein means are provided for releasing said guide-rope from said submarine device.

13. A submarine system as defined by claim 11 wherein said guide-rope comprises a plurality of bodies having highly concentrated masses, and a plurality of low-mass linkages flexibly coupling adjacent bodies to each other.

14. A submarine system as defined by claim 13 wherein said plurality of linked bodies is enclosed in a sheath having an outer skin with a smooth surface finish for assuring adequate penetration of said guide-rope in said fluid environment.

15. A submarine system as defined by claim 13 wherein a portion of said bodies have apertures therein for receiving a flexible rope and which further comprises a spacing device mounted on said rope between adjacent bodies for keeping said bodies apart.

16. A submarine system as defined by claim 15 wherein said spacing device comprises a pair of sleeves attached to said flexible rope approximately at the respective outlets of the apertures provided in each of the adjacent bodies.

* * * * *